US011639840B2

(12) United States Patent
Corsetti

(10) Patent No.: US 11,639,840 B2
(45) Date of Patent: May 2, 2023

(54) HOLSTERS AND METHODS OF USE

(71) Applicant: Nino Corsetti, Frankfort, IL (US)

(72) Inventor: Nino Corsetti, Frankfort, IL (US)

( * ) Notice: Subject to any disclaimer, the term of this patent is extended or adjusted under 35 U.S.C. 154(b) by 83 days.

(21) Appl. No.: 17/407,395

(22) Filed: Aug. 20, 2021

(65) Prior Publication Data

US 2022/0057169 A1 Feb. 24, 2022

Related U.S. Application Data

(60) Provisional application No. 63/068,029, filed on Aug. 20, 2020.

(51) Int. Cl.
*F41C 33/02* (2006.01)
*F41C 33/04* (2006.01)

(52) U.S. Cl.
CPC ..... *F41C 33/0209* (2013.01); *F41C 33/046* (2013.01)

(58) Field of Classification Search
CPC ..... F41C 33/02; F41C 33/006; F41C 33/008; F41C 33/0272; F41C 33/0209; F41C 33/046; F41C 33/0218; F41C 33/0227; F41C 33/0236
See application file for complete search history.

(56) References Cited

U.S. PATENT DOCUMENTS 4,258,871 A * 3/1981 McMahon ..... F41C 33/046 224/192
6,398,089 B1 * 6/2002 Har-Shen ..... F41C 33/0209 224/912
11,490,718 B2 * 11/2022 Lederle ..... A45F 5/00
2006/0226185 A1 * 10/2006 Har-Shen ..... F41C 33/0209 224/244
2019/0014892 A1 * 1/2019 Bryant ..... A45F 5/021

* cited by examiner

*Primary Examiner* — Corey N Skurdal
(74) *Attorney, Agent, or Firm* — Hartman Global IP Law; Gary M. Hartman; Domenica N. S. Hartman

(57) ABSTRACT

Holsters suitable for securely retaining an item, such as a handgun, to an individual that enables removal of the item with a single hand when the individual is in a sitting position. Such a holster includes at least first and second holster subcomponents that have at least first and second partial cavities, respectively. The first and second holster subcomponents are assemblable to align the first and second partial cavities to define a pocket that is configured so that the first and second holster subcomponents are interlocked together to define the holster when an item is placed in the pocket and the first and second holster subcomponents are simultaneously released from each other in response to the item being removed from the pocket.

20 Claims, 8 Drawing Sheets

HOLSTERS AND METHODS OF USE

CROSS REFERENCE TO RELATED APPLICATIONS

This application claims the benefit of U.S. Provisional Application No. 63/068,029, filed Aug. 20, 2020, the contents of which are incorporated herein by reference.

BACKGROUND OF THE INVENTION

The present invention generally relates to holsters. The invention particularly relates to holsters configured to secure a handgun or other item to an individual while the individual is sitting, for example, in a vehicle.

There are a wide variety of firearm holsters available for holding and securing handguns. These holsters are configured to secure the handgun in locations on an individual's body such as at the ribs, waistline, thigh, or ankle. In addition, various holsters are available that are configured to secure a handgun to a fixed structure, such as furniture. Regardless of the securement location for which a holster is adapted, the general intent of a holster is typically to enable an individual to quickly draw or remove the handgun from the holster in the event of an emergency or other situation when use of the handgun is desired.

Issues may arise when using conventional holsters while the individual is in a sitting position, such as in a seat of a motor vehicle. Holsters are not typically configured for this type of situation, and as such an individual's ability to draw the handgun may be hindered. For example, an individual sitting in a vehicle may have problems drawing the handgun if the handgun and/or holster are obstructed by a seatbelt. In addition, due to the individual's seated position in a relatively confined space (i.e., a motor vehicle), drawing of the handgun from the holster may require the individual to twist or contort their body and/or may require the individual to use both hands, that is, one hand to draw the handgun and the other to steady the holster, adjust an article of clothing, adjust an obstruction such as a seatbelt, etc. In addition to hindering the use of the handgun, if the individual is driving the vehicle the potential requirement of using two hands to draw the weapon necessitates that the individual let go of the steering wheel, which may cause loss of control over the vehicle.

Perhaps due in part to these issues, some individuals decide to forego the use of a holster while seated in a vehicle. For example, an individual may rest the handgun on a passenger seat, on their lap, or below their lap. These practices come with their own potential drawbacks such as the accidental discharge of the unsecured handgun and/or the handgun becoming dislodged or sliding during braking, turning, or a collision, as well as damage to the vehicle's upholstery or molding.

Certain holsters are available that are specifically configured to be mounted in a vehicle in locations such as below or to a side of a steering wheel, on a front end of or below a seat, or in an arm rest (e.g., center console) or a glove compartment. While these holsters may address some issues relating to ease of drawing the handgun and maintaining the handgun in a secure position during operation of the vehicle, they are generally fixed in the vehicle and cannot easily be used outside of the vehicle or in another vehicle.

Therefore, it can be appreciated that it would be desirable if a holster was available that was capable of securely retaining a handgun in a manner that allows a seated individual to quickly and easily draw the handgun with a single hand.

BRIEF DESCRIPTION OF THE INVENTION

The present invention provides holsters and methods for their use. The holsters are suitable for securely retaining an item, such as a handgun, to an individual that allows for quick withdrawal of the item with a single hand even when the individual is in a sitting position.

According to one aspect of the invention, a holster is provided that includes at least first and second holster subcomponents that comprise at least first and second partial cavities, respectively. The first and second holster subcomponents are assemblable to align the first and second partial cavities to define a pocket that is configured so that the first and second holster subcomponents are interlocked together to define the holster when an item is placed in the pocket and the first and second holster subcomponents are simultaneously released from each other in response to the item being removed from the pocket.

According to another aspect of the invention, a firearm holster is provided that includes at least first and second holster subcomponents that are configured to assemble with each other to define a pocket that is configured to receive and retain a handgun. The first and second holster subcomponents are configured to interlock with each other while the handgun is located in the pocket and configured to simultaneously release from each other when the handgun is removed from the pocket. The firearm holster further includes at least one strap configured to secure the first and second holster subcomponents to one another. The firearm holster is configured to be secured to an individual by wrapping the at least one strap about a body part of the individual and then interlock the first and second holster subcomponents by placing the handgun in the pocket. Simultaneously releasing the first and second holster subcomponents from each other by removing the handgun from the pocket simultaneously causes the firearm holster to release from the individual.

According to another aspect of the invention, a method is provided that includes securing a handgun to an individual with a firearm holster such that the handgun is retained within a pocket of the firearm holster, and removing the handgun from the pocket of the firearm holster, wherein subcomponents of the firearm holster interlock together to define the firearm holster when the handgun is placed in the pocket and the subcomponents are simultaneously released from each other in response to the handgun being removed from the pocket.

Technical effects of the holsters and method described above preferably include the ability to secure a handgun (or other item) to an individual while seated in a vehicle in a manner that allows for convenient removal of the item while also simultaneously releasing the holster from the individual.

Other aspects and advantages of this invention will be appreciated from the following detailed description.

BRIEF DESCRIPTION OF THE DRAWINGS

FIGS. 3 and 4 represent subcomponents of the firearm holster of FIGS. 1 and 2 that are separated from each other, wherein FIG. 3 represents the subcomponents interconnected with a pair of straps that are connected together by a coupling and FIG. 4 represents the pair of straps disconnected at the coupling.

DETAILED DESCRIPTION OF THE INVENTION

Figure 1:
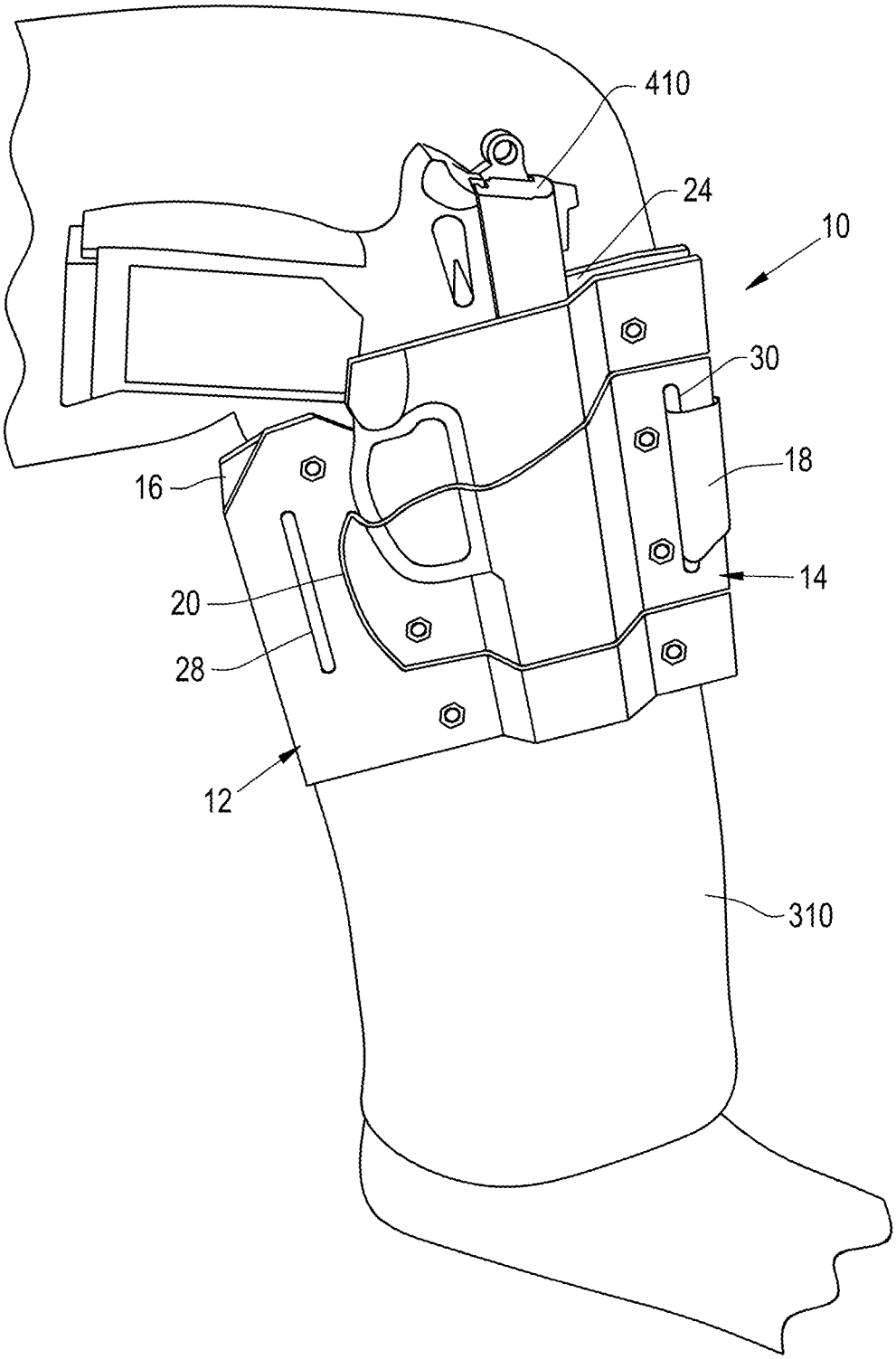
FIGS. 1 and 2 represent two opposing side views of an individual's leg depicting a first embodiment of a firearm holster secured to the leg and in which a handgun is secured in the firearm holster in accordance with certain nonlimiting aspects of the invention.

The intended purpose of the following detailed description of the invention and the phraseology and terminology employed therein is to describe what is shown in the drawings, which include the depiction of one or more nonlimiting embodiments of the invention, and to describe certain but not all aspects of what is depicted in the drawings, including the embodiment(s) depicted in the drawings. The following detailed description also identifies certain but not all alternatives of the embodiment(s) depicted in the drawings. Therefore, the appended claims, and not the detailed description, are intended to particularly point out subject matter regarded as the invention, including certain but not necessarily all of the aspects and alternatives described in the detailed description.

Figure 2:
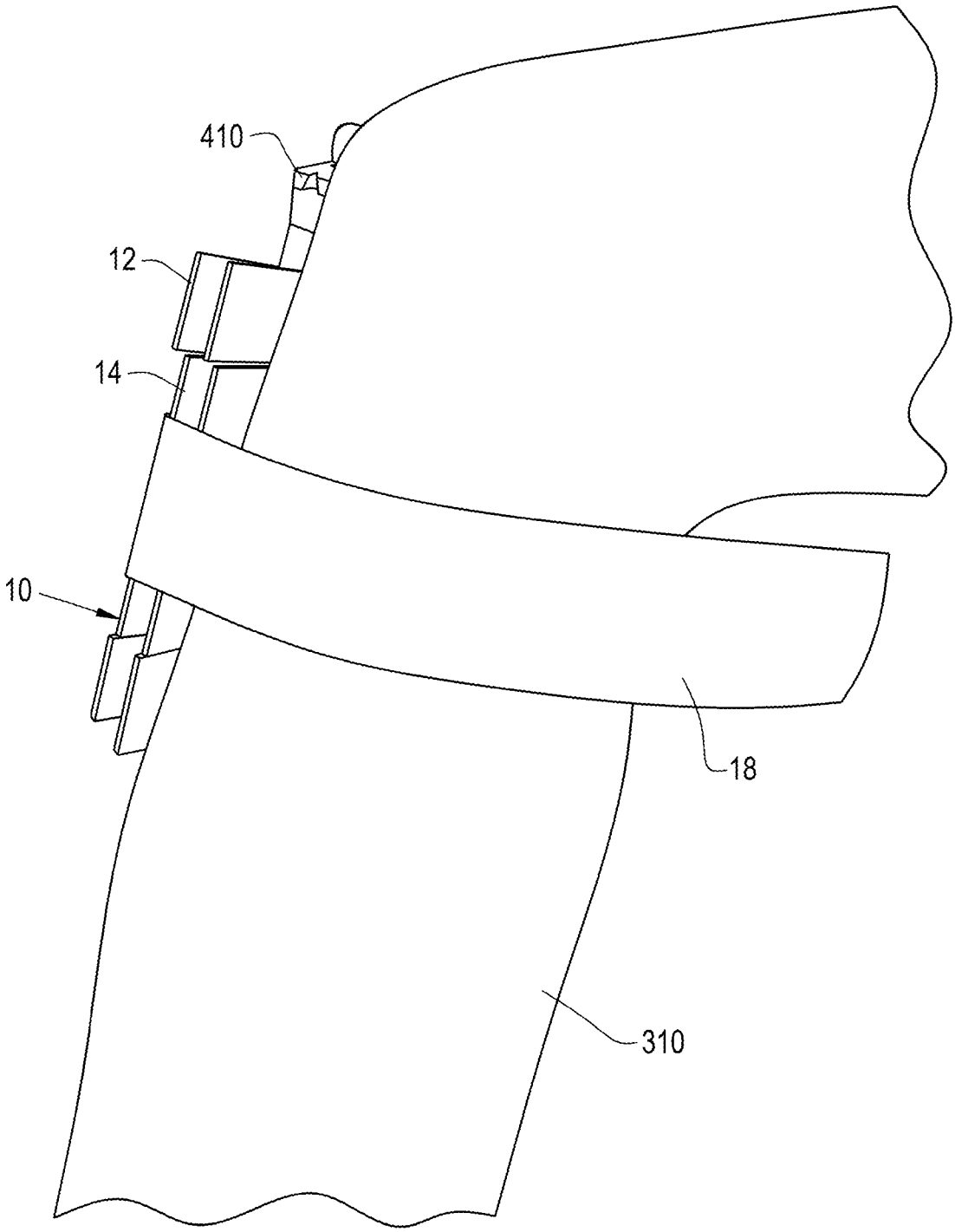

The following describes embodiments of holsters that are configured to secure to an individual a weapon, such as a handgun 410 represented in FIGS. 1 and 2. The holsters are particularly beneficial for use by individuals while in a seated position, such as when traveling in a motor vehicle. In particular, the depicted holsters are configured to receive and retain a handgun, secure the handgun against a portion of an individual's body, such as below the knee (i.e., lower leg) of an individual's leg 310 as shown in FIGS. 1 and 2, and automatically be released from the individual by removing the handgun from the holsters. As such, the holsters provide a convenient method for supporting a handgun that may reduce the likelihood of the holsters causing obstruction or tangling of the legs of the individual in the event of the handgun being drawn therefrom. Although the holsters are described herein and represented in the drawings as configured for being secured to the lower leg 310 of the individual, it should be apparent that the holsters may be configured to be secured to locations of individuals other than the lower leg 310.

Figure 3:
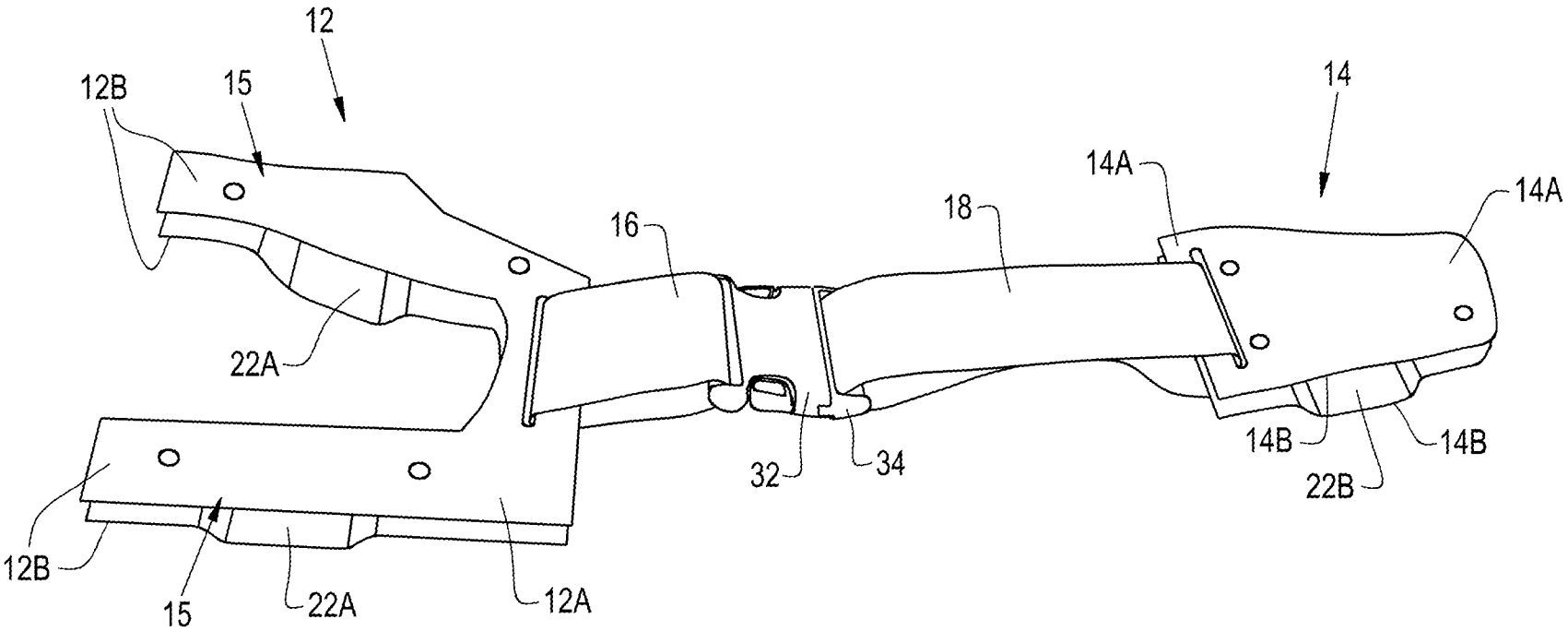
Figure 4:
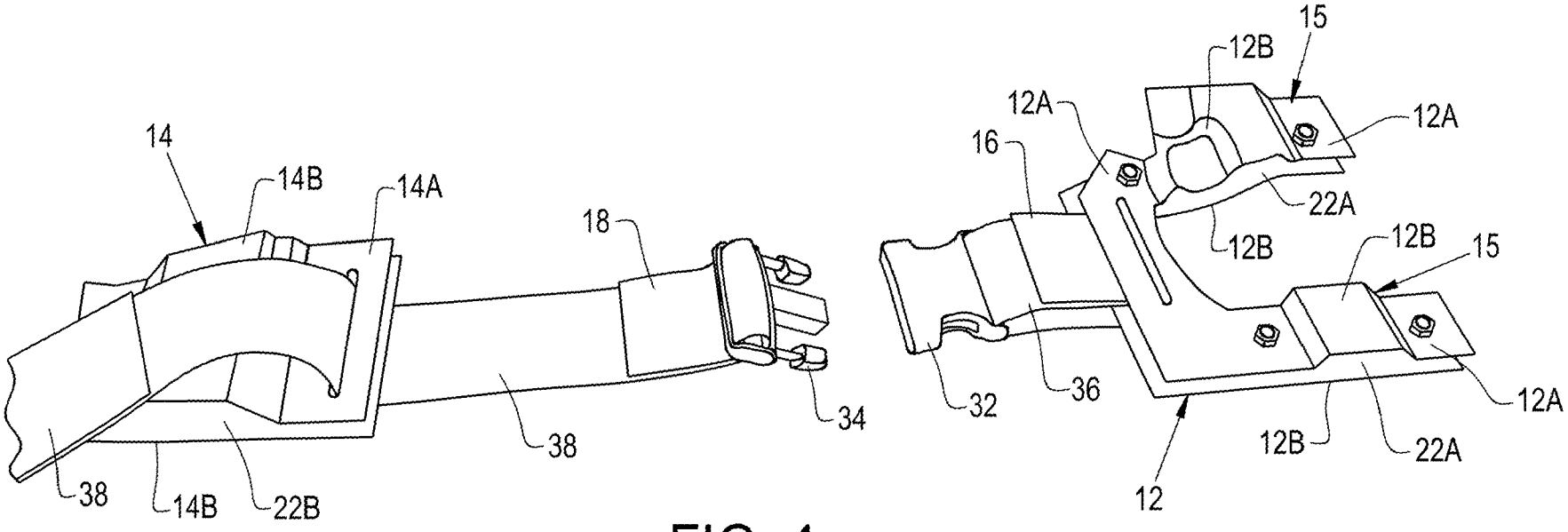
Figure 5:
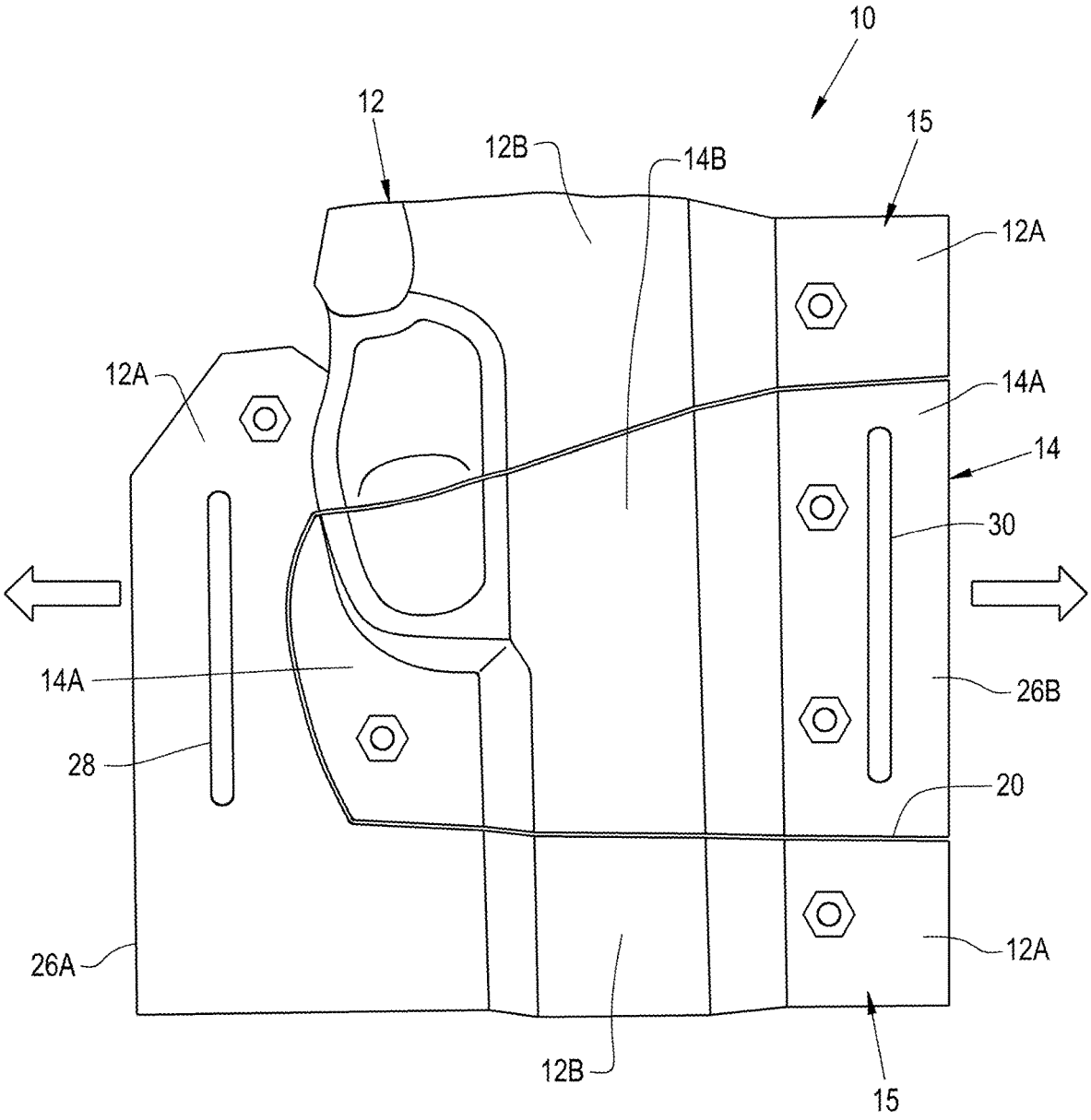
FIG. 5 represents an isolated front view of the subcomponents of the firearm holster of FIGS. 1 through 4, evidencing the manner in which the holster is an assembly of the subcomponents.
Figure 6:
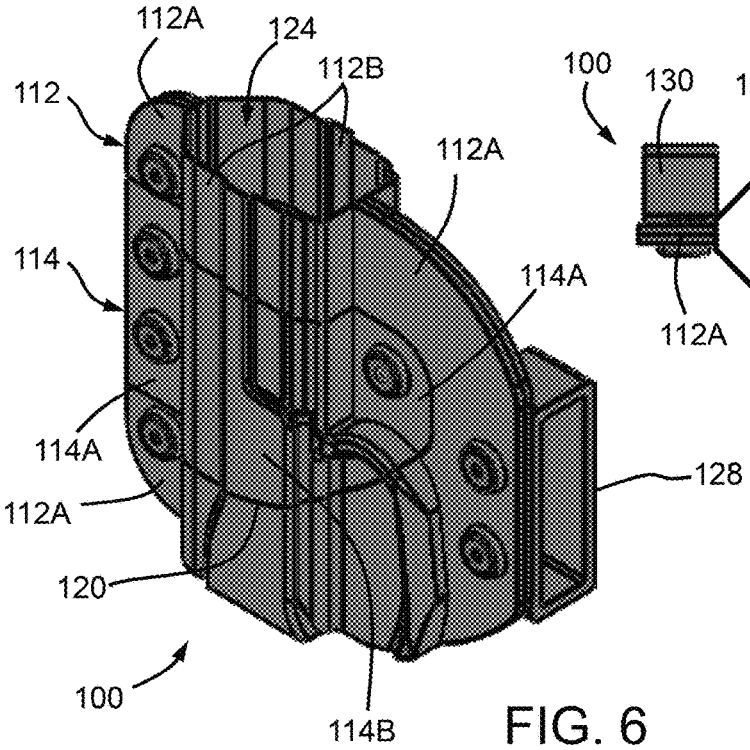
FIGS. 6 through 10 represent, respectively, perspective, front, top, right end, and exploded views of a second embodiment of a firearm holster in accordance with certain nonlimiting aspects of the invention.
Figure 8:
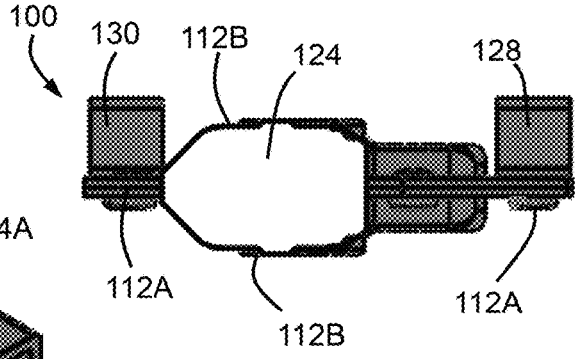
Figure 7:
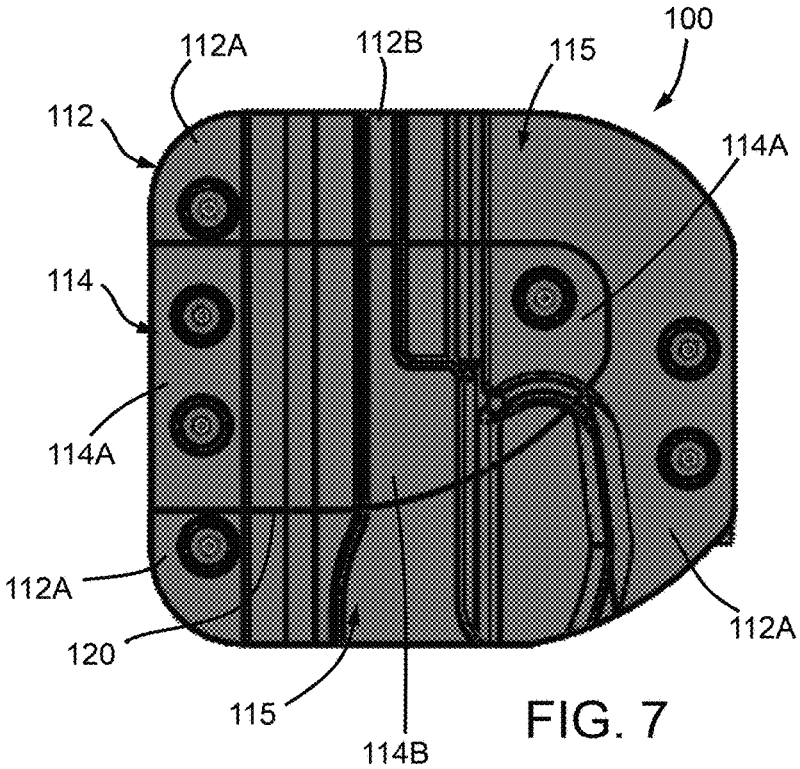
Figure 9:
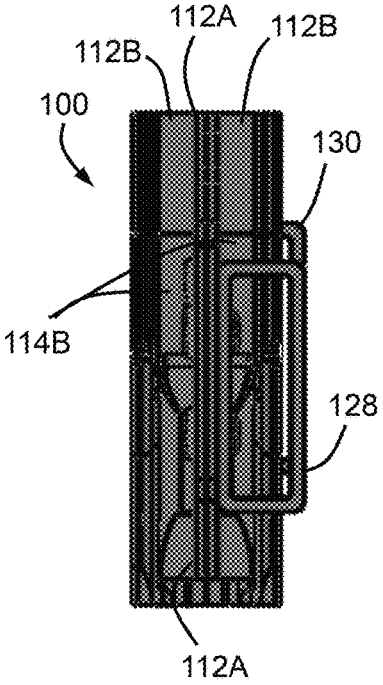

FIGS. 1 and 2 show a first embodiment of a firearm holster 10 secured to an individual's leg 310 and securing the handgun 410 thereto. The holster 10 includes at least two separate (sometimes referred to herein as first and second) holster subcomponents 12 and 14. As more readily apparent in FIG. 5, the holster subcomponents 12 and 14 are complementary to each other and when assembled form what may be referred to as a holster assembly. The holster subcomponent 14 in its entirety is receivable between (interdigitated with) two legs 15 of the holster subcomponent 12, with a continuous separation or gap 20 therebetween so that the subcomponents 12 and 14 can be selectively assembled with each other and disassembled from each other without any interference fit therebetween. Each holster subcomponent 12 and 14 includes a base component (referred to herein as base portions 12A and 14A) and a cavity component (referred to herein as cavity portions). As more readily apparent in FIGS. 3 and 4, the cavity portion of the holster subcomponent 12 comprises a pair of cavity members 12B that are spaced apart from each other to define a partial cavity 22A therebetween, and the cavity portion of the holster subcomponent 14 comprises a pair of cavity members 14B that are spaced apart from each other to define a partial cavity 22B therebetween, such that each holster subcomponent 12 and 14 comprises one of the partial cavities 22A and 22B. When assembled together, the holster subcomponents 12 and 14 form parts of the holster 10 that are adapted and configured to secure the handgun 410 thereto. In particular, when the subcomponents 12 and 14 are assembled with each other as shown in FIGS. 1, 2, and 5, the partial cavities 22A and 22B of the holster subcomponents 12 and 14 are aligned to define in combination a continuous uninterrupted cavity between the subcomponents 12 and 14, forming what is referred to herein as a pocket 24 (FIG. 1) that is sized and shaped complementary to the handgun 410 intended to be secured with the holster 10. When present within the pocket 24, the handgun 410 serves as the sole means for interlocking the subcomponents 12 and 14, preventing their disassembly from each other. As such, removal of the handgun 410 from the pocket 24 simultaneously frees the subcomponents 12 and 14 from each other, allowing the subcomponents 12 and 14 to freely separate from each other without impediment.

The base portions 12A and 14A of the holster subcomponents 12 and 14 combine to define a composite base of the resulting holster 10. As indicated in FIG. 5, the composite base comprises two end portions 26A and 26B separated by the cavity members 12B and 14B that combined to define the pocket 24. Slots 28 and 30 are defined in the end portions 26A and 26B, respectively. In the nonlimiting embodiment shown in FIGS. 1 through 5, the slot 28 is defined entirely within the base portion 12A of the first holster subcomponent 12 and the slot 30 is defined entirely within the base portion 14A of the second holster subcomponent 14.

In FIGS. 1 and 2, the first and second holster subcomponents 12 and 14 are shown as secured to the individual's lower leg 310 with straps 16 and 18 (sometimes referred to herein as first and second straps 16 and 18). As more readily seen in FIGS. 3 and 4, the straps 16 and 18 are threaded through the slots 28 and 30 in the holster subcomponents 12 and 14, respectively, and may be secured thereto with hook and loop fasteners 36 and 38, respectively, at first ends thereof. The straps 16 and 18 are preferably capable of being coupled to one another at second ends thereof with side release buckle fasteners 32 and 34. FIG. 4 shows the hook and loop fastener 38 of the second strap 18 as disconnected. In certain other embodiments, the first and second holster subcomponents 12 and 14 may be coupled with a single, adjustable strap rather than two separate straps 16 and 18. Furthermore, means other than straps could be used to secure the holster 10 to the individual's lower leg 310 or to another anatomical region of the individual.

Though the embodiment of FIGS. 1 through 5 utilizes two complementary holster subcomponents 12 and 14, the holster 10 could comprise more than two holster subcomponents that are configured to be combined to define the pocket 24 and end portions 26A and 26B of the holster 10. Furthermore, the first holster subcomponent 12 could have more than two legs 15 that receive two or more complementary portions of the second holster subcomponent 14.

In the embodiment of FIGS. 1 through 5, the base portion 12A and cavity members 12B of the first holster subcomponent 12 are coupled together with fasteners, rivets, or the like, and the base portion 12B and cavity members 14B of the second holster subcomponent 14 are coupled together with fasteners, rivets, or the like. Alternatively, either or both of the holster subcomponents 12 and 14 may be integrally formed as a single unitary component, for example, formed of a molded or machined material. For example, the holster subcomponents 12 and 14 may each be formed of an integral, molded polymeric material fabricated using a suitable molding technique, such as injection molding.

As noted above, in the embodiment represented in FIGS. 1 through 5 the first and second holster subcomponents 12 and 14 are not required to be equipped with any means for attaching and interconnecting to each other, for example, as a result of being directly coupled with one or more interlocking interfaces located on either subcomponent 12 and 14 to yield the holster 10. Instead, the gap 20 separates the subcomponents 12 and 14 when they are arranged as shown in FIGS. 1, 2, and 5, and while located in the pocket 24 the handgun 410 functions as a temporary intermediate interlocking feature that preferably serves as the sole means by which the subcomponents 12 and 14 are interconnected together to yield the holster 10. In other words, the handgun 410 located within the pocket 24 (FIGS. 1 and 2) comprises the sole means by which the holster subcomponents 12 and 14 are secured together, and the holster subcomponents 12 and 14 freely disassemble with each other in the absence of the handgun 410 in the pocket (FIG. 5), such that removing the handgun 410 from the pocket 24 in FIGS. 1 and 2 releases the holster subcomponents 12 and 14 from each other, which for example, enables the subcomponents 12 and 14 to move in opposite directions as indicated by the arrows in FIG. 5. Under the effect of gravity, once the handgun 410 is removed from the pocket 24 the holster subcomponents 12 and 14 are released from each other and free to fall, thereby releasing the holster 10 from the individual.

As shown in the FIGS. 1 and 5, the first and second holster subcomponents 12 and 14 fit together such that the second holster subcomponent 14 is between and partially surrounded by the legs 15 of the first holster subcomponent 12. This feature is not strictly required as the partial cavities 22A and 22B of the holster subcomponents 12 and 14 may be merely aligned side by side and the holster subcomponents 12 and 14 secured together by the handgun 410 when located within the pocket 24 formed by the partial cavities 22A and 22B. However, an arrangement in which one of the holster subcomponents is partially surrounded by the other holster subcomponent may reduce the likelihood that gaps or misalignment will occur between the holster subcomponents 12 and 14. As such, interdigitating portions of the subcomponents 12 and 14 is believed to reduce the likelihood that the holster subcomponents 12 and 14 will disengage while the handgun 410 is retained in the pocket 24 defined by the partial cavities 22A and 22B.

During use, an individual may couple the side release buckle fasteners 32 and 34 of the straps 16 and 18 to each other, assemble the subcomponents 12 and 14 to align their partial cavities 22A and 22B and thereby form the pocket 24, interlock the holster subcomponents 12 and 14 by placing a handgun 410 in the pocket 24, and then wrap the coupled straps 16 and 18 around their lower leg 310 and tighten the resulting holster assembly around their leg 310 by pulling on the free end of the strap 18 before securing the strap 18 to itself with the hook and loop fastener 38 of the strap 18. Alternatively, the coupled straps 16 and 18 could be wrapped around the lower leg 310 before interlocking the holster subcomponents 12 and 14 by placing a handgun 410 in the pocket 24 of the holster 10. Once the partial cavities 22A and 22B of the subcomponents 12 and 14 are aligned to form the pocket 24, the handgun 410 can be fully inserted into the pocket 24 to act as an intermediate interlocking feature that secures the holster subcomponents 12 and 14 together to yield the holster 10. The individual may then adjust the tightness of the firearm holster 10 on their lower leg 310 by releasing, for example, the hook and loop fastener 36 of the strap 18 and then adjusting the amount of the strap 18 that is inserted through the slot 30 before again coupling the hook and loop fastener 36. Subsequently, the individual may remove the handgun 410 from the pocket 24, with the result that the holster subcomponents 12 and 14 are simultaneously disconnected from one another, releasing the entire holster 10 from the lower leg 310 to enable the holster 10 to fall from the lower leg 310 under the force of gravity.

Use of the firearm holster 10 while seated provides a natural (e.g., ergonomic), vertical draw of the handgun 410 from the pocket 24. Further, drawing the handgun 410 and releasing the firearm holster 10 from the lower leg 310 may significantly reduce the likelihood of tripping or obstruction to the individual's movement by the holster 10. In addition, once the straps 16 and 18 have been adjusted to the desired length, an individual can quickly and repeatedly attach the firearm holster 10 to their lower leg 310 as desired by simply inserting the handgun 410 into the pocket 24 formed by the partial cavities 22A and 22B while the holster subcomponents 12 and 14 are arranged as represented in FIG. 5. Since the holster 10 is not permanently mounted or affixed to the vehicle, it can easily be transported to and used in other vehicles or locations.

FIGS. 6 through 11 represent second and third embodiments of firearm holsters 100 and 200. In FIGS. 6 through 11, consistent reference numbers are used to identify elements or components that are the same or functional equivalents of elements or components identified in FIGS. 1 through 5, but with a numerical prefix (1 or 2) added to distinguish the particular embodiment from the embodiment of FIGS. 1 through 5. In view of similarities between the first, second, and third embodiments, the following discussion of FIGS. 6 through 11 will focus primarily on aspects of the additional embodiments that differ from the embodiment of FIGS. 1 through 5 in some notable or significant manner. Other aspects of the additional embodiments not discussed in any detail can be, in terms of structure, function, materials, etc., essentially as was described for the first embodiment.

Figure 10:
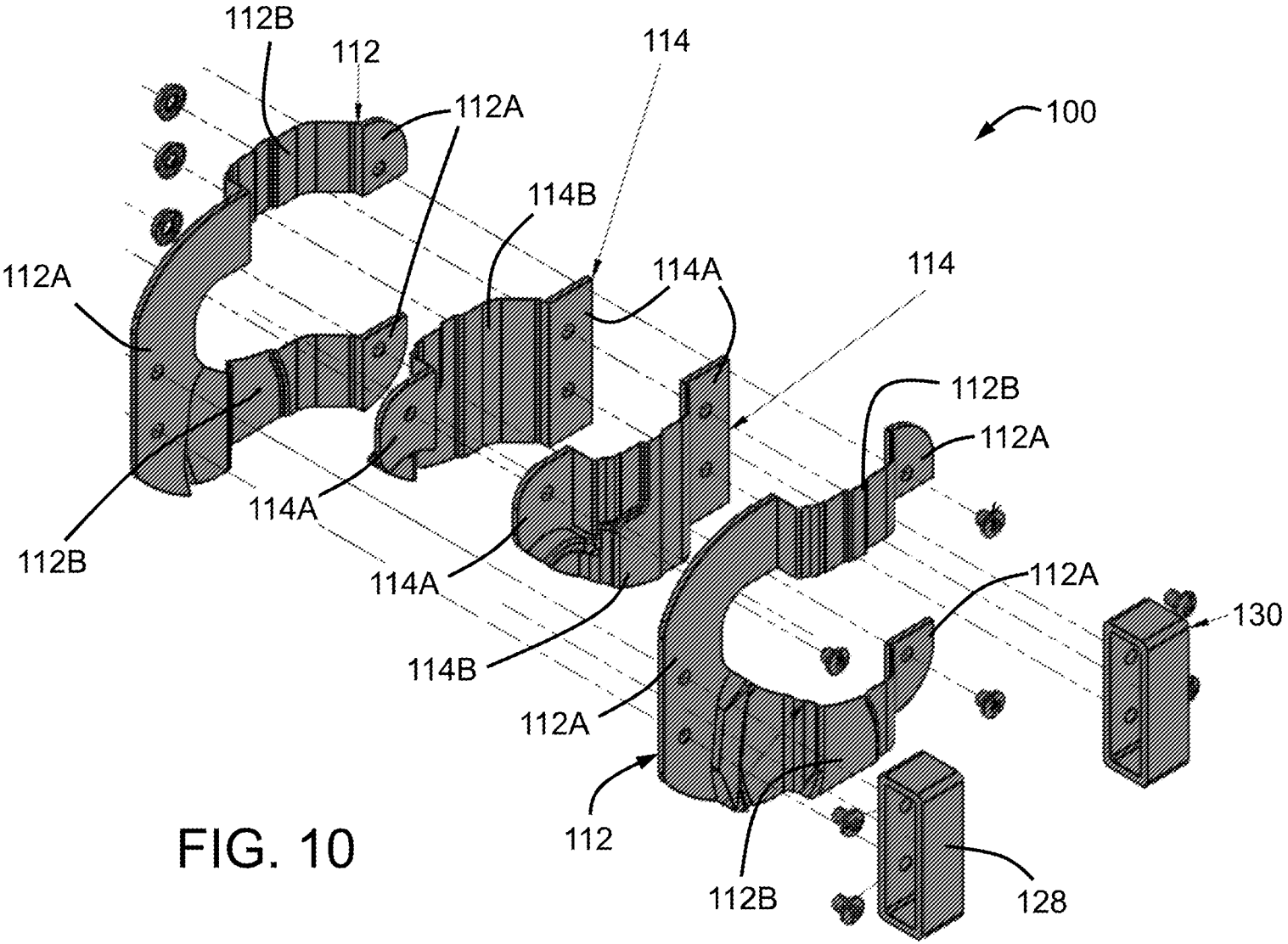
Figure 11:
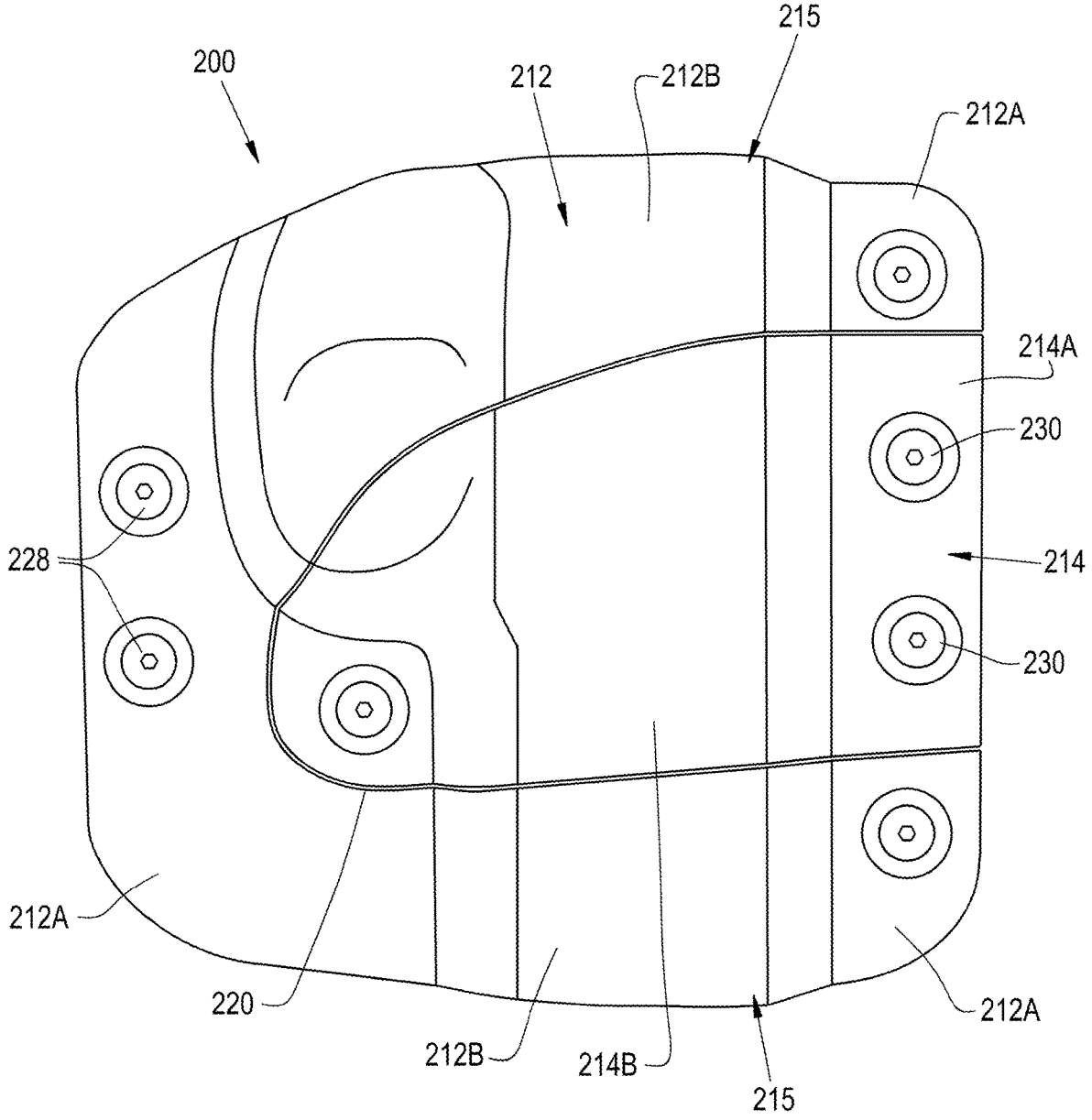
FIG. 11 represents an isolated front view of a third embodiment of a firearm holster in accordance with certain nonlimiting aspects of the invention.

Similar to the embodiment of FIGS. 1 through 5, FIGS. 6 through 10 represent the firearm holster 100 comprising holster subcomponents 112 and 114, and FIG. 11 represents the firearm holster 200 comprising holster subcomponents 212 and 214. The holster subcomponents 112, 114, 212 and 214 may be used as alternatives for the holster subcomponents 12 and 14 of the embodiment of FIGS. 1 through 5. As such, the holster subcomponents 112, 114, 212 and 214 may be used in combination with the straps 16 and 18 for securing the handgun 410 to an individual.

In the embodiment of FIGS. 6 through 10, the holster subcomponents 112 and 114 do not include the slots 28 and 30 of the first embodiment. Instead, belt loops 128 and 130 are located on surfaces of the base portions 112A and 114A of the holster subcomponents 112 and 114. Therefore, the holster subcomponents 112 and 114 may be used with the straps 16 and 18 in a manner similar to that described for the first embodiment, or may be used with a single body belt or strap (not shown) that passes through both belt loops 128 and 130. FIG. 10 represents each of the holster subcomponents 112 and 114 as comprising two separate pieces that are secured together with fasteners to form their respective holster subcomponent 112 or 114. The separate pieces of the subcomponent 112 (both labeled as 112 in FIG. 10) are represented in FIG. 10 as mirror images of each other. Similarly, the separate pieces of the subcomponent 114 (both labeled as 114 in FIG. 10) are represented in FIG. 10 as mirror images of each other. Fasteners that secure the belt loop 128 to the subcomponent 112 can serve to simultaneously secure the pieces of the subcomponent 112 together at its base portion 112A, and fasteners that secure the belt loop 130 to the subcomponent 114 can serve to simultaneously secure the pieces of the subcomponent 114 together at its base portion 114A.

Referring to FIG. 11, the third embodiment differs from the first embodiment in that the holster subcomponents 212 and 214 are fabricated of pliable materials so that the pocket (unnumbered in FIG. 11) is able to elastically conform to the shape of a handgun placed in the pocket, with the result that the holster 200 may have a smaller profile relative to the holster 10 of FIGS. 1 through 5. In addition, the holster subcomponents 212 and 214 are configured to be permanently or releasably coupled to straps (not shown) with fasteners 228 and 230, such as rivets, rather than the slots 28 and 30 of the first embodiment.

Various alternative embodiments are foreseeable in addition to the embodiments described above. In addition, it is foreseeable that the holsters 10, 100, and 200 may be configured to receive and support items other than or in addition to a handgun. In such embodiments, the holster subcomponents 12, 14, 112, 114, 212, and 214 may be retained in fixed positions relative to each other while the one or more items act as interconnecting features within one or more pockets defined by the holster subcomponents 12, 14, 112, 114, 212, and 214. Such other items may include but are not limited to nonlethal weapons such as pepper spray and stun guns, flashlights, knives, extra magazines/ammunition for a handgun, etc.

In embodiments in which the firearm holsters 10, 100, and 200 are intended to be attached to the anatomy of an individual with a strap, the firearm holster 10 may include means for assisting the individual in securing the holsters 10, 100, and 200 to a body part. For example, the holsters 10, 100, and 200 may include temporary means of interlocking the holster subcomponents 12, 14, 112, 114, 212, and 214 to each other while the strap is manipulated such that the holsters 10, 100, and 200 may first be secured to the individual, the gun can be inserted, and then the temporary interlocking means released. Such temporary interlocking means may include but is not limited to various connectors and fasteners such as push pins, clips, clasps, latches, etc. In such embodiments, the handgun 410 (or other item) is intended to be the sole means by which the holster subcomponents 12 and 14 are secured together while the holster 10, 100, or 200 is worn by the individual, so that the holster subcomponents 12, 14, 112, 114, 212, and 214 will freely disassemble with each other in the absence of the handgun 410 in the pocket.

The holsters 10, 100, and 200 and their components may be formed of various materials. For example, the straps 16 and 18 may include various natural or synthetic leather materials and/or natural or synthetic, woven or nonwoven fabric materials. The holster subcomponents 12, 14, 112, 114, 212, and 214 may include various molded, machined, or otherwise formed metallic materials, polymeric materials, ceramic materials, and/or composite materials. The holster subcomponents 12, 14, 112, 114, 212, and 214 may even include natural or synthetic, woven or nonwoven fabric or leather materials if constructed in a manner that is sufficiently rigid to function in the manner described herein.

While the invention has been described in terms of specific or particular embodiments, it is apparent that other forms could be adopted by one skilled in the art. For example, the physical configuration of the holsters 10, 100, and 200 could differ from that shown, and materials and processes/methods other than those noted could be used. In addition, the invention encompasses additional embodiments in which one or more features or aspects of different disclosed embodiments may be combined or one or more features or aspects of a particular embodiment could be omitted. Therefore, the scope of the invention is to be limited only by the following claims.

The invention claimed is:

1. A holster comprising:

at least first and second holster subcomponents that comprise at least first and second partial cavities, respectively, the first and second holster subcomponents being assemblable to align the first and second partial cavities to define a pocket; and the pocket being configured so that the first and second holster subcomponents are interlocked together to define the holster when an item is placed in the pocket and the first and second holster subcomponents are simultaneously released from each other in response to the item being removed from the pocket.

2. The holster of claim 1, wherein the first and second holster subcomponents are complementary to each other and interdigitated with each other so that a continuous gap separates the first and second holster subcomponents and the first and second holster subcomponents can be selectively assembled with each other and disassembled from each other without any interference fit therebetween.

3. The holster of claim 1, wherein the first and second holster subcomponents are assemblable so that the first holster subcomponent at least partially surrounds by the second holster subcomponent.

4. The holster of claim 1, wherein the first and second holster subcomponents each include a base portion and a cavity portion, the cavity portion of the first holster subcomponent comprises cavity members that are spaced apart from each other to define the first partial cavity therebetween, and the cavity portion of the second holster subcomponent comprises cavity members that are spaced apart from each other to define the second partial cavity therebetween.

5. The holster of claim 1, further comprising one or more straps configured to releasably secure the holster to the individual, the one or more straps including at least a first strap coupled to the first and/or second holster subcomponents and configured to secure the holster to an individual.

6. The holster of claim 1, further comprising:

a first strap coupled to the first holster subcomponent at a first end thereof and having a first fastener at a second end thereof; and a second strap coupled to the second holster subcomponent at a first end thereof having a second fastener at a second end thereof;

wherein the first and second fasteners are configured to mate to secure the first and second straps to each other.

7. The holster of claim 6, wherein the first and second holster subcomponents include first and second slots, respectively, configured to receive the first and second straps, respectively.

8. The holster of claim 1, wherein the pocket is configured to receive a handgun as the item, and the first and second holster subcomponents are configured so that the handgun while within the pocket can by itself interlock the first and second holster subcomponents together.

9. A firearm holster comprising:

at least first and second holster subcomponents that are configured to assemble with each other to define a pocket that is configured to receive and retain a handgun, the first and second holster subcomponents being configured to interlock with each other while the handgun is located in the pocket and configured to simultaneously release from each other when the handgun is removed from the pocket; and at least one strap configured to secure the first and second holster subcomponents to one another;

wherein the firearm holster is configured to be secured to an individual by wrapping the at least one strap about a body part of the individual and then interlock the first and second holster subcomponents by placing the handgun in the pocket;

wherein simultaneously releasing the first and second holster subcomponents from each other by removing the handgun from the pocket simultaneously causes the firearm holster to release from the individual.

10. The firearm holster of claim 9, wherein the first and second holster subcomponents are configured so that the handgun while within the pocket can by itself interlock the first and second holster subcomponents together.

11. The firearm holster of claim 9, wherein the at least one strap is configured to be adjustable to selectively increase or reduce a length of the at least one strap between the first and second holster subcomponents.

12. The firearm holster of claim 9, wherein the firearm holster is configured to be secured to a lower leg of the individual by wrapping the at least one strap about the lower leg and then interlock the first and second holster subcomponents by inserting the handgun into the pocket.

13. A method comprising:

securing a handgun to an individual with a firearm holster such that the handgun is retained within a pocket of the firearm holster; and removing the handgun from the pocket of the firearm holster;

wherein subcomponents of the firearm holster interlock together to define the firearm holster when the handgun is placed in the pocket and the subcomponents are simultaneously released from each other in response to the handgun being removed from the pocket.

14. The method of claim 13, further comprising:

assembling the subcomponents of the firearm holster with each other to define the pocket of the firearm holster;

inserting the handgun into the pocket of the firearm holster to interlock the subcomponents; and removing the handgun from the pocket of the firearm holster to simultaneously release the subcomponents from each other.

15. The method of claim 14, wherein the firearm holster comprises at least one strap that secures the subcomponents to each other, the method comprising wrapping the at least one strap about a body part of the individual, interlocking the subcomponents, and inserting the handgun into the pocket to secure the at least one strap and the subcomponents to the individual.

16. The firearm holster of claim 15, further comprising adjusting the at least one strap to selectively increase or reduce a length of the at least one strap between the subcomponents.

17. The method of claim 14, wherein the handgun while within the pocket solely interlocks the subcomponents together.

18. The method of claim 13, wherein the firearm holster is secured to a lower leg of the individual.

19. The method of claim 13, wherein the subcomponents each comprise a partial cavity, the method comprising assembling the subcomponents to align the partial cavities thereof and thereby define the pocket.

20. The method of claim 19, wherein the subcomponents are assembled with each other so as to be interdigitated with each other.

* * * * *